US009929540B1

(12) United States Patent
Boll et al.

(10) Patent No.: US 9,929,540 B1
(45) Date of Patent: Mar. 27, 2018

(54) SPARK PLUG GROUND ELECTRODE

(71) Applicants: DENSO International America, Inc., Southfield, MI (US); DENSO CORPORATION, Kariya, Aichi-pref. (JP)

(72) Inventors: Harrison Boll, Grosse Pointe Farms, MI (US); Jeongung Hwang, Northville, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/666,189

(22) Filed: Aug. 1, 2017

(51) Int. Cl.
*H01T 13/20* (2006.01)
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS 5,581,145 A 12/1996 Kato et al.
7,652,413 B2 1/2010 Kawashima
8,912,714 B2 12/2014 Ban et al.
2002/0081932 A1* 6/2002 Hanai ..... B23K 11/0046 445/7
2009/0127997 A1* 5/2009 Kameda ..... H01T 13/32 313/141
2009/0289540 A1* 11/2009 Nunome ..... C22C 5/04 313/141
2010/0314987 A1* 12/2010 Kyuno ..... H01T 13/20 313/130
2010/0320894 A1 12/2010 Hartmann et al.
2011/0215702 A1* 9/2011 Kameda ..... H01T 13/32 313/141
2013/0099652 A1* 4/2013 Below ..... H01T 13/02 313/140
2014/0159563 A1* 6/2014 Shibata ..... H01T 13/02 313/141
2014/0361678 A1* 12/2014 Murayama ..... H01T 13/32 313/141
2015/0002011 A1* 1/2015 Imai ..... H01T 13/32 313/142
2015/0372458 A1* 12/2015 Matsumura ..... H01T 13/20 313/141

FOREIGN PATENT DOCUMENTS

JP 2014022300 A 2/2014

* cited by examiner

*Primary Examiner* — Donald Raleigh
(74) *Attorney, Agent, or Firm* — Harness, Dickey & Pierce, P.L.C.

(57) ABSTRACT

A spark plug including a center electrode having a center electrode tip. A ground electrode strap has a ground electrode base to which a ground electrode pad is mounted. The ground electrode base is trapezoid-shaped in cross-section. The ground electrode strap is triangular-shaped in cross-section.

15 Claims, 2 Drawing Sheets

SPARK PLUG GROUND ELECTRODE

FIELD

The present disclosure relates to a spark plug ground electrode.

BACKGROUND

This section provides background information related to the present disclosure, which is not necessarily prior art.

While current spark plugs are suitable for their intended use, they are subject to improvement. For example, current spark plugs often have a ground electrode geometry that uses a "ground strap" that is very wide and can reduce probably of ignition due to shielding of the electrode from the air/fuel mixture. Such a configuration does not effectively use the thermal quenching effect (whereby cooler center and ground electrodes drain energy of the spark plug flame core by way of heat transfer) in high temperature environments. The present teachings address these issues with current spark plugs, as well as numerous other issues. For example and as explained in detail herein, the spark plug of the present teachings advantageously increases the thermal quench effect (i.e., provides greater heat dispersion), and improves the air/fuel flow around the ground electrode due to the shape described herein, as opposed to the rectangular shape of existing electrodes. Furthermore, the shape of the ground electrode described herein advantageously helps the incoming air/fuel mixture reach the sparking area of the spark plug.

SUMMARY

This section provides a general summary of the disclosure, and is not a comprehensive disclosure of its full scope or all of its features.

The present teachings include a spark plug having a center electrode with a center electrode tip. A ground electrode strap has a ground electrode base to which a ground electrode pad is mounted. The ground electrode base is trapezoid-shaped in cross-section. The ground electrode strap is triangular-shaped in cross-section.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
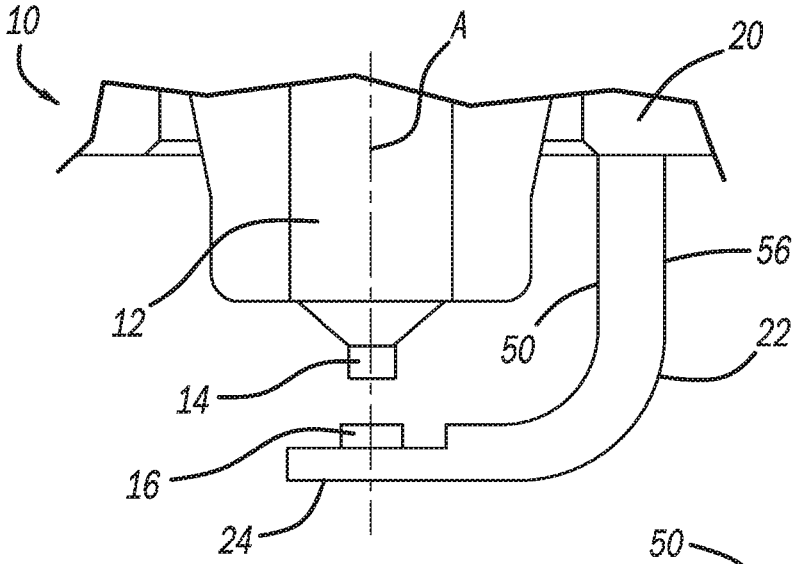
FIG. 1 is a side view of a spark plug in accordance with the present teachings.

With initial reference to FIG. 1, a spark plug in accordance with the present teachings is illustrated at reference numeral 10. The spark plug 10 can be any suitable spark plug for use with any suitable engine. For example, the engine may be any suitable vehicle engine. The vehicle engine may be for a passenger vehicle, mass transit vehicle, military vehicle, construction vehicle, aircraft, watercraft, etc. The spark plug may also be used with non-vehicular engines, such as generator engines or engines for other machinery, systems, equipment, etc.

The spark plug 10 generally includes a center electrode 12 having a center electrode tip 14. Arranged opposite to the center electrode tip 14 along a longitudinal axis A of the spark plug 10 is a ground electrode pad 16. Extending from a housing 20 of the spark plug 10 is a ground electrode strap or arm 22. At a distal end of the ground electrode strap 22 is a ground electrode base 24. The ground electrode pad 16 is mounted to the ground electrode base 24 in any suitable manner, such as by welding.

Figure 2:
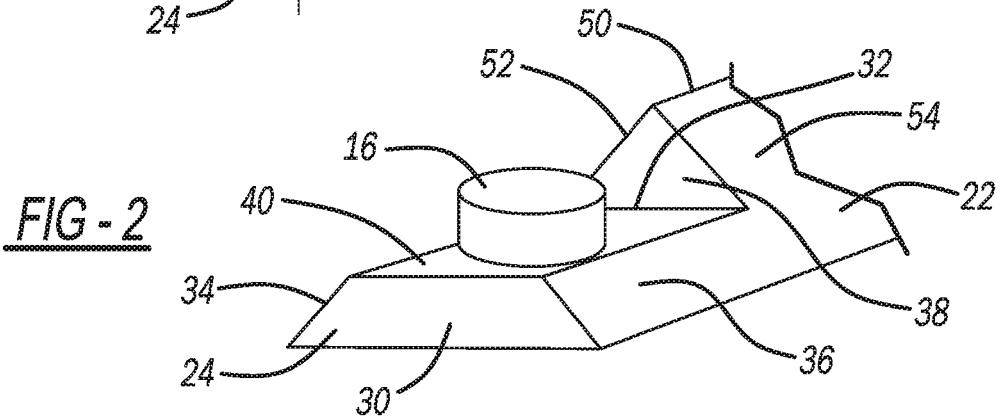
FIG. 2 is a perspective view of a ground electrode base of the spark plug of FIG. 1 with a ground electrode pad mounted thereon.

With continued reference to FIG. 1 and additional reference to FIG. 2, the ground electrode base 24 includes an end portion 30 and an inner portion 32. The inner portion 32 is opposite to the end portion 30, and abuts a triangular shaped end surface 38 of the ground electrode strap 22. The ground electrode base 24 further includes a first side portion 34 and a second side portion 36, which is opposite to the first side portion 34. The ground electrode base 24 also includes a mounting surface 40 to which the ground electrode pad is mounted to in any suitable manner, such as by welding.

Figure 3:
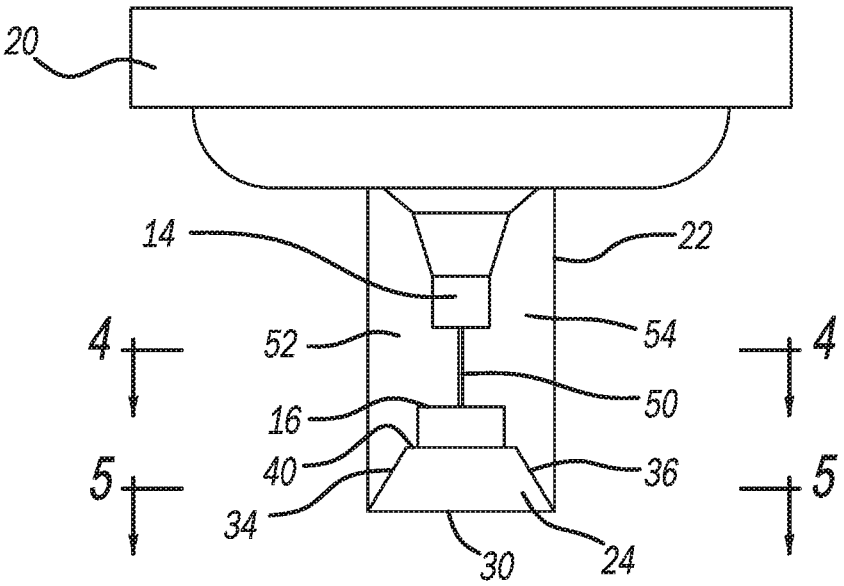
FIG. 3 is a side view of the spark plug of FIG. 1.
Figure 5:
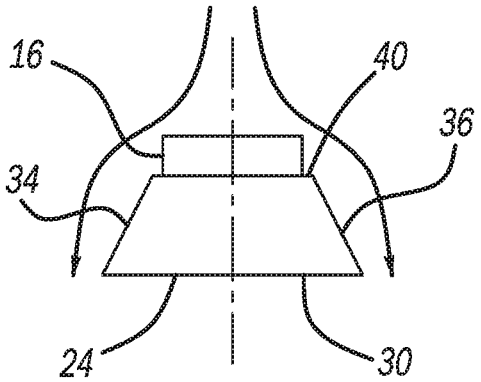
FIG. 5 is a cross-sectional view of the ground electrode base taken along line 5-5 of FIG. 4.

The mounting surface 40 is formed in any suitable manner, such as by machining. Specifically, the ground electrode base 24 is machined down to provide the planar mounting surface 40. Machining the ground electrode base 24 to provide the mounting surface 40 results in the end surface 38 of the ground electrode strap 22 having a triangular shape. Machining the ground electrode base 24 to provide the mounting surface 40 also results in the ground electrode base 24 having a generally trapezoidal shape, particularly in cross-section as illustrated in FIG. 5 and described further herein. The trapezoidal shape of the ground electrode base 24 is also visible in FIGS. 2 and 3.

Figure 4:
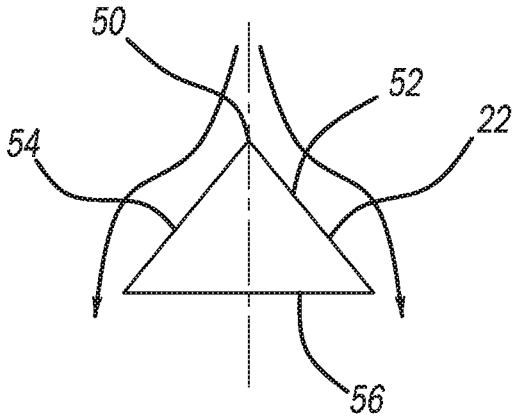
FIG. 4 is a cross-sectional view of a ground electrode arm of the spark plug taken along line 4-4.

With reference to FIGS. 1-4, the ground electrode strap 22 generally includes an inner peak or point 50, which extends furthest toward the longitudinal axis A. The inner peak 50 extends along the ground electrode strap 22 from the housing 20 to the triangular-shaped end surface 38. Proximate to the triangular-shaped end surface 38, the inner peak 50 generally provides an upper surface of the ground electrode strap 22, which is closest to the center electrode 12, and arranged above the mounting surface 40. Extending from the inner peak or point 50 is a first inner surface 52 and a second inner surface 54 of the ground electrode strap 22. The first and second inner surfaces 52 and 54 extend to an outer surface 56. The outer surface 56 is generally planar and opposite to the inner peak 50, such as illustrated in FIG. 4 for example. FIG. 4 is a cross-sectional view of the ground electrode strap 22 taken along line 4-4 of FIG. 3, and illustrates the triangular shape of the ground electrode strap 22 in cross-section. FIG. 5 is a cross-sectional view of the ground electrode base 24 taken along line 5-5 of FIG. 3, and illustrates the trapezoidal shape of the ground electrode base 24.

The triangular shape of the ground electrode strap 22 and the trapezoidal shape of the ground electrode base 24 provide the spark plug 10 with numerous advantages. For example, these shapes improve the flow of the air/fuel mixture around the ground electrode pad 16 and the center electrode tip 14. Specifically, the triangular shape of the ground electrode strap 22 helps the incoming air/fuel mixture reach the sparking area between the center electrode tip 14 and the ground electrode pad 16. This improved air/fuel mixture flow also advantageously increases the thermal quench effect (i.e., provides greater heat dispersion). The trapezoidal shape of the ground electrode base 24 provides increased surface area for the ground electrode pad 16 to be mounted upon, which allows for a more secure connection between the ground electrode pad 16 and the mounting surface 40 (e.g., such as by welding).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A spark plug comprising:

a center electrode having a center electrode tip; and a ground electrode strap having a ground electrode base to which a ground electrode pad is mounted;

wherein the ground electrode base is trapezoid-shaped in cross-section; and wherein the ground electrode strap is triangular-shaped in cross-section.

2. The spark plug of claim 1, wherein the ground electrode base includes a planar surface to which the ground electrode pad is mounted.

3. The spark plug of claim 2, wherein the ground electrode pad is welded to the planar surface.

4. The spark plug of claim 2, wherein the planar surface is a machined surface.

5. The spark plug of claim 2, wherein the planar surface is recessed beneath an upper surface of the ground electrode strap.

6. The spark plug of claim 2, wherein a triangular side surface of the ground electrode strap abuts the planar surface of the ground electrode base.

7. The spark plug of claim 1, wherein the ground electrode strap includes an inner peak and two planar surfaces extending from the inner peak to a flat surface to define the triangular-shape.

8. The spark plug of claim 1, wherein the trapezoid-shape of the ground electrode base is defined by two planar surfaces extending parallel to each other, and two angled surfaces connecting the two planar surfaces together; and wherein the ground electrode pad is mounted to one of the two planar surfaces.

9. A spark plug comprising:

a center electrode having a center electrode tip, the center electrode arranged along a longitudinal axis of the spark plug;

a ground electrode pad opposite to the center electrode tip; and a ground electrode strap having a ground electrode base at an end portion thereof, the ground electrode pad is mounted to a planar portion of the ground electrode base;

wherein:

in cross-section the ground electrode base has a trapezoid shape that includes the planar portion to which the ground electrode pad is mounted; and in cross-section the ground electrode strap has a triangular shape configured to direct an air/fuel mixture to the center electrode and the ground electrode for combustion.

10. The spark plug of claim 9, wherein the planar portion of the ground electrode base is machined beneath an upper surface of the ground electrode strap.

11. The spark plug of claim 9, wherein a triangular side surface of the ground electrode strap abuts the planar portion of the ground electrode base.

12. The spark plug of claim 9, wherein the ground electrode strap has an inner peak at an innermost portion of the ground electrode strap.

13. The spark plug of claim 12, wherein the ground electrode strap further includes a first planar surface and a second planar surface both extending from the inner peak to an outer surface; and wherein the first planar surface, the second planar surface, and the outer surface define the triangular shape of the ground electrode strap in cross-section.

14. The spark plug of claim 13, wherein the outer surface is a planar surface.

15. The spark plug of claim 13, wherein the ground electrode base has a first side portion that is continuous with the first planar surface and a second side portion that is continuous with the second planar surface.

* * * * *